United States Patent [19]

Lambrechts et al.

[11] Patent Number: 4,518,160

[45] Date of Patent: May 21, 1985

[54] FLAT ARTICLE STACKING AND TRAY LOADING APPARATUS

[75] Inventors: Eric G. Y. Lambrechts, Antwerp; Herman K. M. Verhoeven, St. Niklaas; Constant J. P. Claes, Deurne, all of Belgium

[73] Assignee: International Standard Electric Corporation, New York, N.Y.

[21] Appl. No.: 496,335

[22] Filed: May 23, 1983

Related U.S. Application Data

[63] Continuation of Ser. No. 209,236, Nov. 21, 1980, abandoned.

[30] Foreign Application Priority Data

Oct. 15, 1980 [EP] European Pat. Off. ..... 80200974.6

[51] Int. Cl.[3] ..... B65H 29/16; B65H 31/06

[52] U.S. Cl. ..... 271/214; 271/179; 271/201; 271/184; 414/107; 53/260; 53/542

[58] Field of Search ..... 271/214, 215, 213, 177, 271/178, 179, 180, 181, 188, 217, 198, 199, 201, 150, 184, 185; 414/103, 104, 105, 106, 107, 108, 109; 53/255, 260, 542

[56] References Cited

U.S. PATENT DOCUMENTS

| | | | |
|---|---|---|---|
| 2,797,098 | 6/1957 | Brodie | 271/178 |
| 2,841,394 | 7/1958 | Stobb | 271/185 |
| 3,051,480 | 8/1962 | Carlin et al. | 271/215 |
| 3,079,151 | 2/1963 | Maidment | 271/224 |
| 3,333,843 | 8/1967 | Misbin et al. | 271/188 |
| 3,729,191 | 4/1973 | Yoshimura et al. | 271/214 |
| 3,759,509 | 9/1973 | Peterson | 271/150 |
| 3,784,191 | 1/1974 | Thiel | 271/214 X |
| 3,865,365 | 2/1975 | Hardin et al. | 271/214 |
| 4,019,730 | 4/1977 | Staudinger et al. | 271/214 X |
| 4,237,677 | 12/1980 | Klapp | 271/214 X |

FOREIGN PATENT DOCUMENTS

| | | | |
|---|---|---|---|
| 2517369 | 8/1976 | Fed. Rep. of Germany | 271/214 |

OTHER PUBLICATIONS

Jackowski, C. S. et al., "Mailtrayer", *IBM Technical Disclosure Bulletin*, vol. 16, No. 11, Apr. 1974, pp. 3535-3537.

*Primary Examiner*—Bruce H. Stoner, Jr.
*Assistant Examiner*—James E. Barlow
*Attorney, Agent, or Firm*—John T. O'Halloran; Peter R. Ruzek; Mary C. Werner

[57] ABSTRACT

A tray loading apparatus includes an inclined support having a displaceable front part so that the front wall of a tray can be brought into abutment with the front end of a stack carried by the support and to be loaded in the tray after a backing plate supporting the stack front end has been removed. The stacking apparatus includes a conveyor able to apply the front portion of each envelope conveyed in a direction making an angle with the above backing plate against this backing plate and a belt arrangement operating on the front portion of each envelope to cant the rear part of the envelope into engagement with a deflector after the front portion has been applied against the backing plate.

4 Claims, 10 Drawing Figures

Fig. 1.
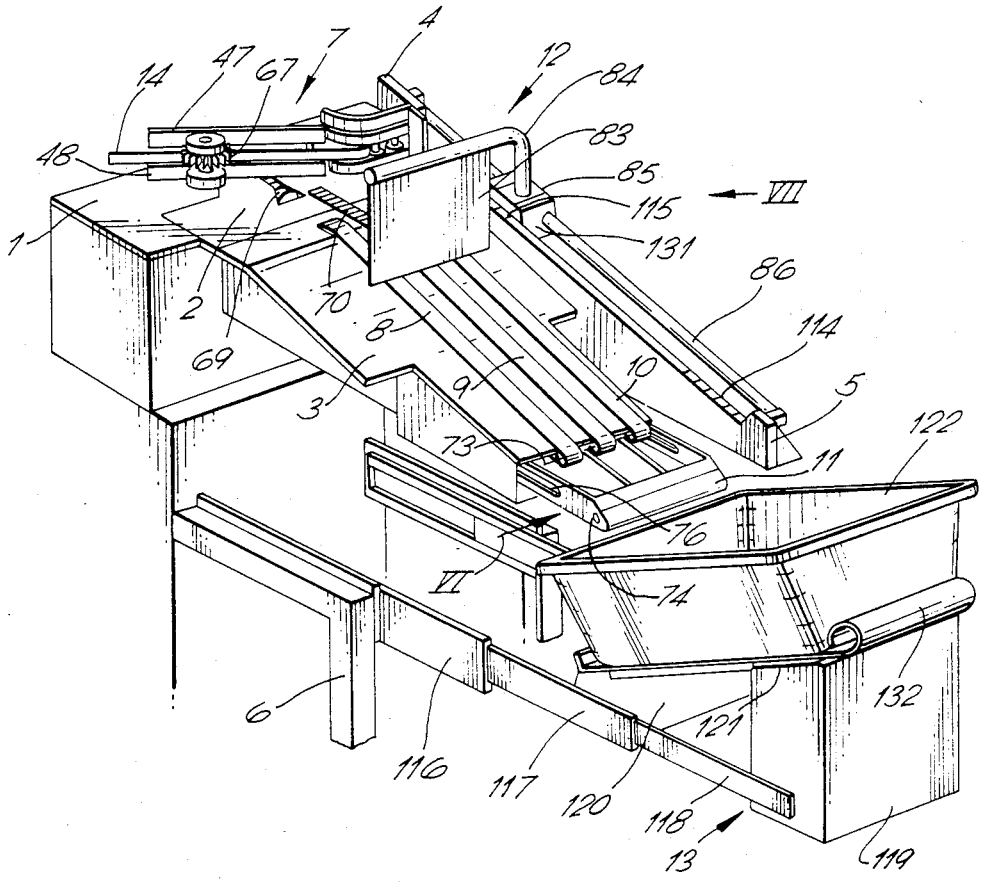
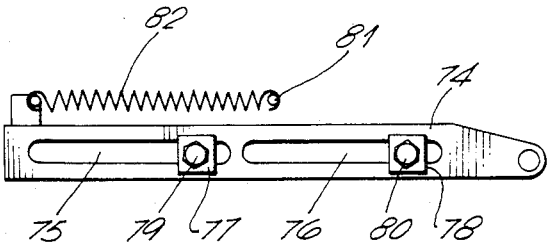
Fig. 6.

12
84
4
85
87
86
107
106
88
112
113
105
109
89
125
108
111
110
91
97
98
131
102
99
100
101
92
96
95
94
103
104
93
90

FLAT ARTICLE STACKING AND TRAY LOADING APPARATUS

This application is a continuation, of application Ser. No.209,236, filed Nov. 21, 1980, now abandoned.

The present invention relates to a tray loading apparatus including a supporting means for a stack of flat articles, a displaceable and removable backing member for retaining the front end of said stack, and a tray having a front wall, said stack being able to be transferred into said tray for various positions of said stack on said supporting means after removal of said backing member, said tray front wall taking over the function of said backing member.

Such an apparatus is already known from U.S. Pat. No. 3,865,365 and more particularly enables the stacking and the subsequent loading of a stack of mail or the like into a tray. Such a stack of mail the front end of which is in any of various positions may be loaded into a tray because the apparatus includes an additional displaceable backing member to temporarily retain the stack front end in this position after the removal of the first named backing member which is constituted by a backing plate and before, during the subsequent loading operation, the function thereof is taken over by the tray front wall. This additional backing member comprises a vertical finger which is mounted on a slidable belt attached to a counterweight which continuously maintains the finger into contact with the stack front and through a slot in the backing plate which is also pulled against this stack front end by another counterweight. During a loading operation the stack is manually slid into a tray against the restraining force exerted by the finger counterweight, this finger being rotated downwardly at the end of its travel in order not to hinder the unloading operation.

Drawbacks of this known tray loading apparatus are the presence of an additional backing member which has to be so mounted that it does not hinder a loading operation and the fact that such a finger supports the stack on a small surface only, so that by the force manually exerted on the stack during a loading operation this stack might pivot about the vertical finger if the load constituted by the stacked documents is not properly divided on both sides of the centrally located finger, e.g. with letters of different sizes.

An object of the present invention is to provide an apparatus of the above type, but which on the one hand does not require the use of an additional backing member to enable the loading of a stack of flat articles the front end of which is in any of various positions, and on the other hand ensures a safer loading operation.

According to the invention this object is achieved due to the fact that said tray and at least part of said supporting means are displaceable to allow said tray front wall to be brought into abutment with said stack front end after the removal of said backing member and for said various positions of said stack.

This apparatus enables the loading of a stack the front end of which is in any of various positions because the tray front wall can be brought in this position due to the part of the support being displaceable and does not require an additional backing member because in this position the function of the first named backing member is immediately taken over by the tray front wall which ensures a firm support on a large surface.

The present invention also relates to a flat article stacking apparatus of the type including a conveyor means, a backing member and a deflector means, said conveyor means being able to convey articles one at a time into a stacking position and apply a front portion of each article being stacked against said backing member or against a previously stacked article and said article deflector means being able to operate on the bottom edge of an article, the front portion of which is being applied against said backing member, in order to deflect the remaining portion of said article into the direction of said backing member.

Such a flat article stacking apparatus, and more particularly a mail stacking apparatus is already known from Australian patent No. 483,480. In this known apparatus, and because each envelope generally possesses a certain stiffness, the latter will be determinant for the deflection of the rear portion of such an envelope in the direction of the backing member upon its front portion being applied against it by the conveyor means. Afterwards the bottom edge of this rear portion drops by gravity into engagement with a corrugated belt which constitutes the above mentioned deflector means and is then deflected into the direction of the backing member. Thus a deflected envelope cannot hinder the arrival of an immediately following one so that the use of the deflector means in principle permits a higher operation speed of the apparatus.

However, this known apparatus does not always operate satisfactorily because the own weight of the envelopes may be insufficient to bring them into engagement with the corrugated belt.

An object of the present invention is to provide a flat article stacking apparatus of the above type but which does not present this drawback.

According to the invention this object is achieved due to the fact that it includes an article canting means able to cant an article, the front portion of which is being applied against said backing member, in such a way that the bottom edge of said remaining portion of said article is forced into engagement with said deflector means.

In this way a flat article is always deflected into the direction of the backing member independently of its weight.

The above mentioned and other objects and features of the invention will become more apparent and the invention itself will be best understood by referring to the following description of an embodiment taken in conjunction with the accompanying drawings in which:

FIG. 1 is a perspective front view of a flat article stacking and tray loading apparatus according to the invention;

FIG. 6 is a side view in the direction of arrow VI of part of the apparatus of FIG. 1 and after some frame parts thereof have been removed;

Figure 2:
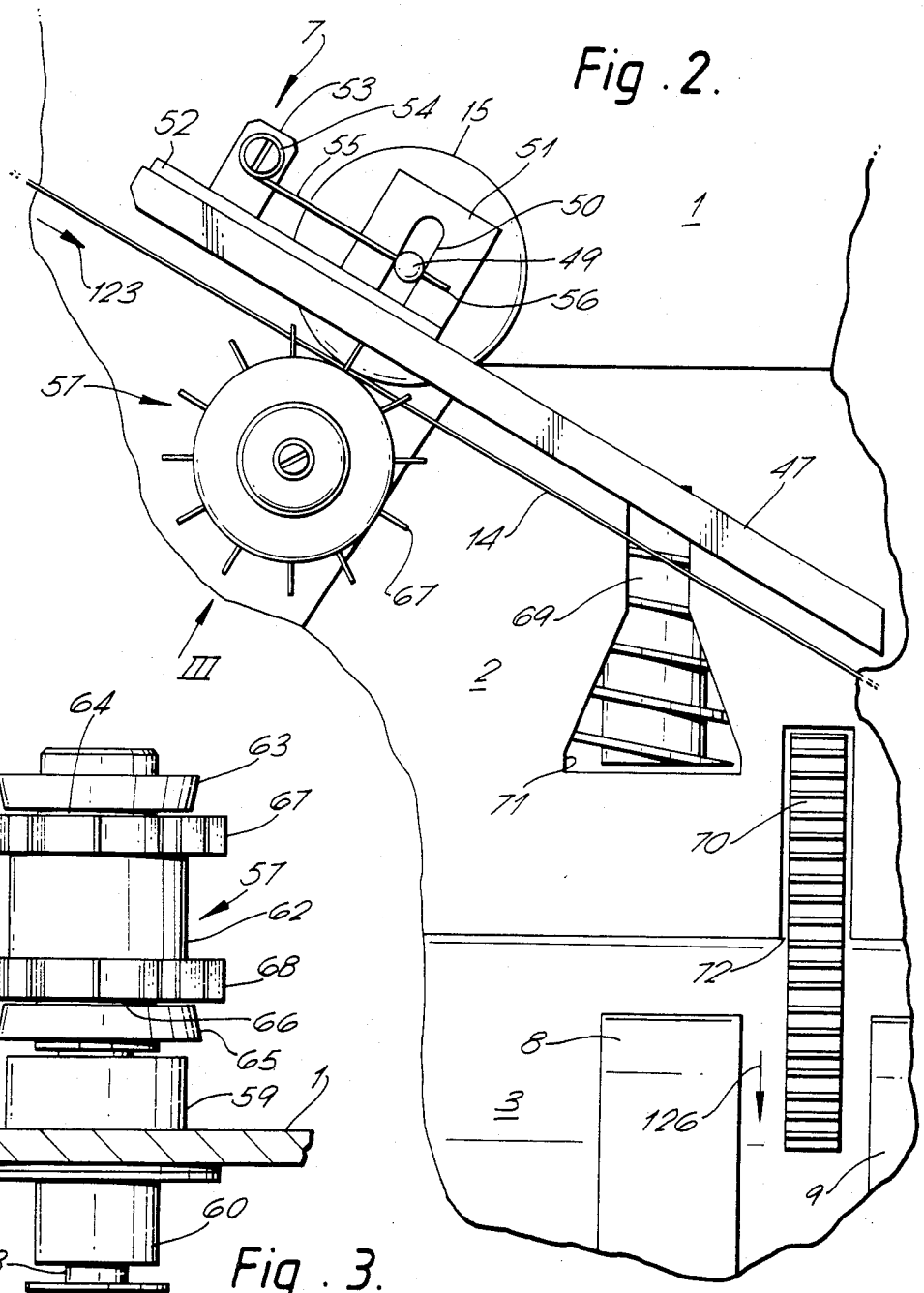
FIG. 2 is a top view at an enlarged scale of part of a stacking apparatus included in the apparatus of FIG. 1.

The flat article stacking and tray loading apparatus shown enables the stacking and the subsequent loading of a stack of mail into a tray and includes a frame structure with a horizontal base plate 1, a support 2, 3 with a horizontal part 2 located slightly below the horizontal base plate 1 and with an inclined part 3 prolonging the horizontal support 2, a vertical side plate 4, an inclined bracket 5 mounted alongside the inclined support 3, and a frame part 6 mounted below this inclined support 3. A stacking apparatus 7 is mounted on the supports 2 and 3; the inclined support 3 carries three flat positioning conveyor belts 8, 9, 10 and a support 11 which is displaceable with respect to the support 3; a backing unit 12 is mounted on side plate 4 and bracket 5; and frame part 6 carries a displaceable tray supporting unit 13.

Figure 3:
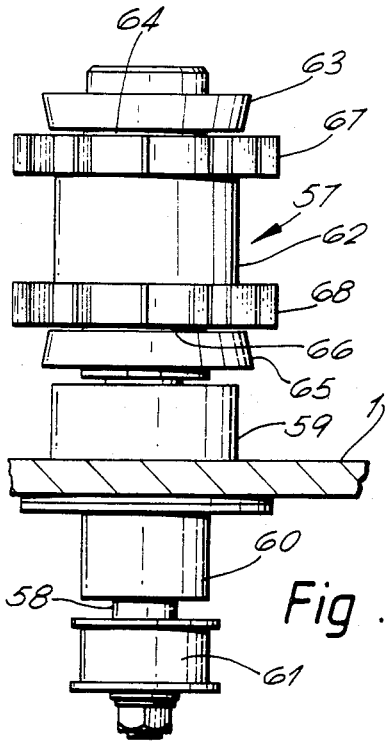
FIG. 3 is a side view in the direction of arrow III of FIG. 2.
Figure 4:
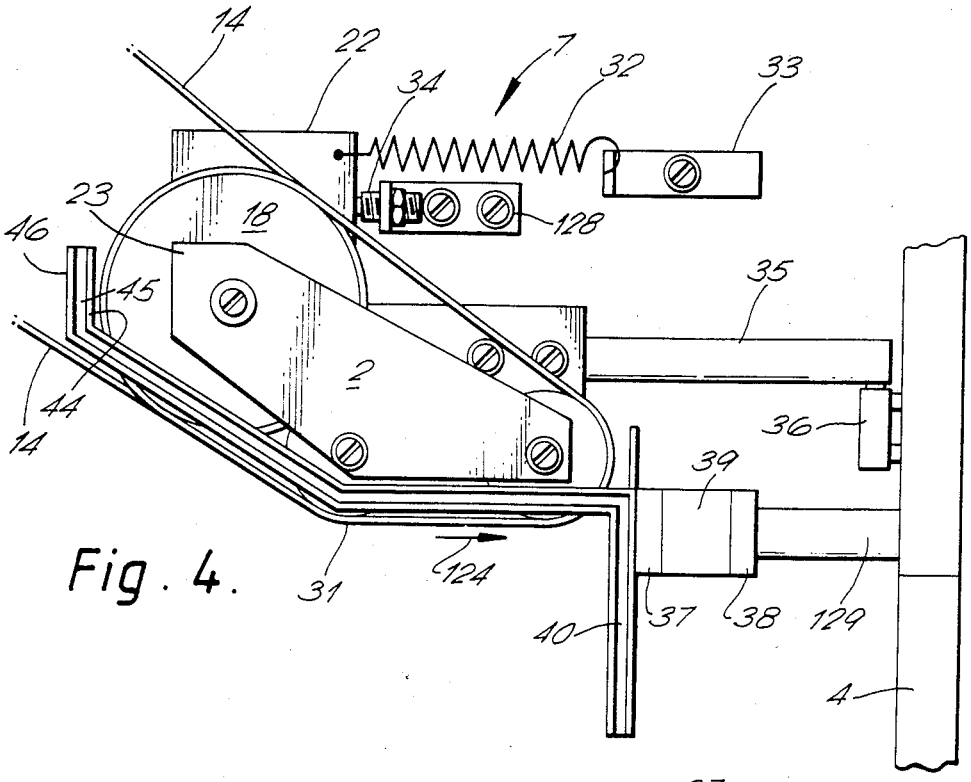
FIG. 4 is a top view at an enlarged scale of another part of the stacking apparatus of the apparatus of FIG. 1.
Figure 5:
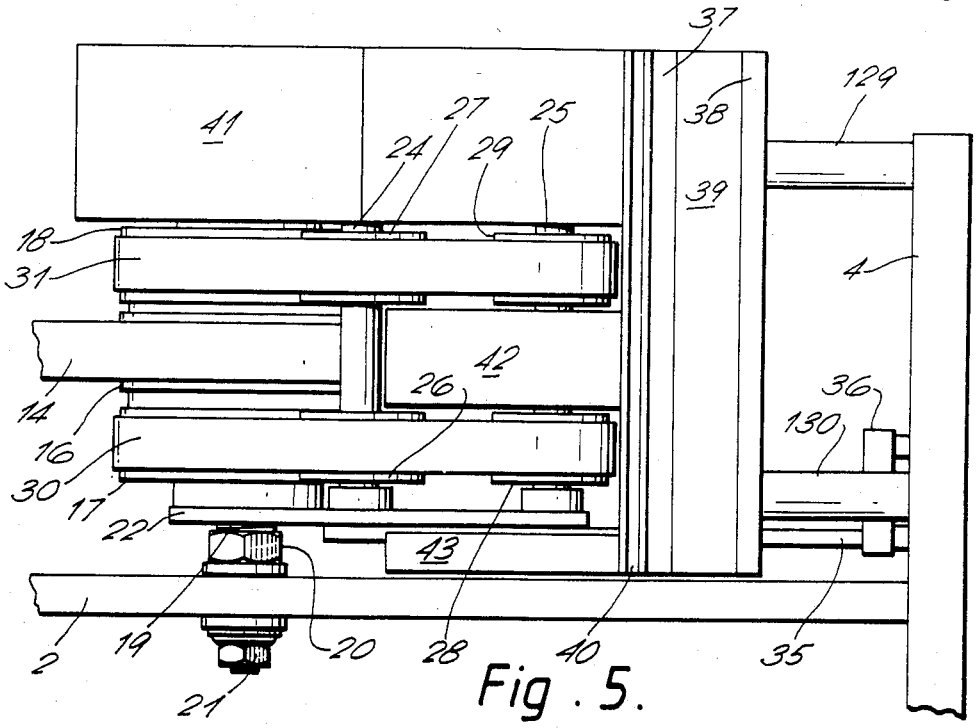
FIG. 5 is a front view of FIG. 4.

The stacking apparatus 7 includes an edgewise conveyor including a belt 14, a plurality of rollers, of which only rollers 15 (FIG. 2) and 62 (FIG. 3) are shown, and a central pulley 16 (FIG. 5) of a three-pulley member, the belt 14 being carried by the rollers such as 15 and the pulley 16. The latter three-pulley member forms part of a pivotally mounted edgewise conveyor which further includes pulleys 17 and 18 and is rotatably mounted on an axle 19 secured to the horizontal support 2 by nuts and washers 20 and 21. The pivotally mounted edgewise conveyor also includes a swivelling bracket with swivelling plates 22 and 23 united by axles 24 and 25 carrying two-pulley members 26, 27 and 28, 29 respectively and pivotally mounted on the axle 19. The pulleys 17, 26 and 28 and 18, 27 and 29 carry endless high and low friction belts 30 and 31 respectively. The various pulleys are so mounted that a portion of the front part of these high and low friction belts 30 and 31 is located in the plane of the conveyor belt 14 and that another portion of this front part is situated in a plane perpendicular to the vertical side plate 4. Swivelling plate 22 is L-shaped and is attached by spring 32 to an L-shaped piece 33 fixed on support 2. Thus the pivotally mounted conveyor is continuously urged into clockwise direction (FIG. 4), its rest position being adjustable by means of an adjustable screw 34 screwed in an L-shaped bracket 128 also fixed on support 2. At its lower side the swivelling plate 22 carries an arm 35 controlling a microswitch 36 fixed on the vertical side plate 4 and constituting a sensing means.

The belts 30 and 31 are identical and each comprise a nylon central layer and two outer layers of rubber and textile respectively, the rubber having a higher friction coefficient than the textile. For the belt 30 the rubber layer is located at the outside, whereas for the belt 31 the texile layer is located at the outside.

A shock-absorbing column 37, 38 ,39 (FIGS. 4,5)is secured to the latter side plate 4 by means of transverse elements 129 and 130. This column comprises two outer metal strips 37 and 38 and a central layer 39 made of rubber. A guide member 40, 41, 42, 43 with a transverse abutment plate 40 and lateral guide elements 41, 42 and 43 is secured to the vertical column 37, 38, 39. The abutment plate 40 is parallel to the vertical side plate 4; the upper guide element 41 is located above the low friction belt 31 whilst the central guide element 42 is located between the pulleys 26, 28 and 27, 29 and the lower element 43 is located below the swivelling plate 22. The guide member 40-43 comprises a metal plate 44 covered by a layer 45 made of rubber and itself covered by a layer 46 made of the same high friction material as the outer layer of belt 30.

The above mentioned roller 15 (FIG. 2) of the edgewise conveyor including belt 14 protrudes through a longitudinal opening between two guide plates 47 and 48 (FIG. 1) which are mounted at a distance above each other at the entrance of the stacking position and in a plane making an acute angle with the plane of the backing unit 12. The roller 15 has an axle 49 the upper and lower ends of which are slidably mounted in slots such as 50 of plastic blocks such as 51 mounted on a plate 52 fixed on the guide plates 47 and 48. Plate 52 carries an L-shaped bracket 53 provided with a vertical pin 54 around which is mounted a coiled spring 55 having a rectilinear end 56 engaged in an opening in the axle 49. This spring 55 continuously urges roller 15 into contact with the conveyor belt 14 against the central roller 62 of a deflection and stiffening unit generally indicated by reference numeral 57 (FIG. 3). This deflection and stiffening unit 57 includes a shaft 58 extending through parts 59 and 60 which are fixed on the horizontal base plate 1. A driving pulley 61 coupled to a not shown driving motor is fixed on the lower end of the shaft 58 which further carries the above mentioned central roller 62 and two like units 63, 64 and 65, 66 each comprising a wheel 63, 65 with a beveled rim and a roller 64, 66 carrying flexible radial vanes 67, 68. The beveled rims are located in intersecting planes.

Figure 10:
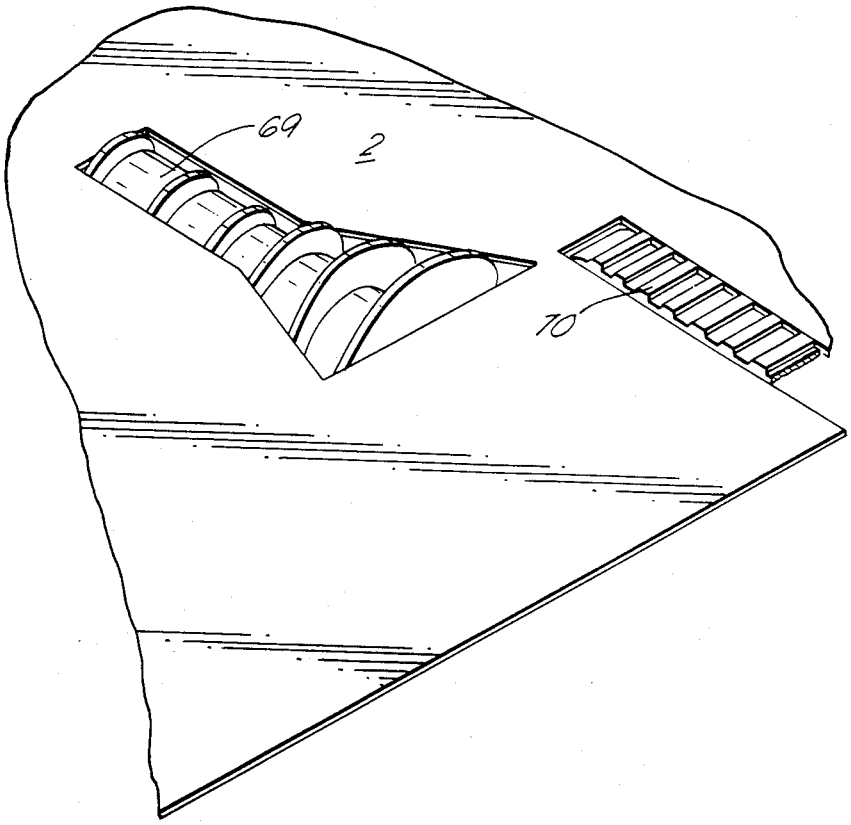
FIG. 10 is a perspective view at an enlarged scale of part of FIG. 2.

The stacking apparatus finally also includes further deflection means able to operate on the lower edge of an envelope, more particularly a horizontally mounted axle 69, with a helical rib, and an endless toothed belt 70 (FIGS. 2, 10). The axle 69 which is substantially perpendicular to the backing unit 12 has a cylindrical portion wherein the height of the helical rib is constant and is located slightly above base plate 2 but below the level of base plate 1 and a frusto-conical portion wherein the height of the helical rib gradually increases well above the level of base plate 1.

The three flat positioning conveyor belts 8, 9, 10 are slidably mounted on the upper surface of the inclined support 3 and are carried by rollers such as 73. Slidable support 11 comprises four longitudinal pieces which are united at their ends and each of the outer pieces such as 74 (FIG. 6) is provided with a pair of longitudinal slots 75 and 76 and is slidably mounted between the flanges of each of two guide members 77 and 78 fixed by means of nuts 79 and 80 on two parallel transverse axles (not shown) extending through the slots 75 and 76. The slidable support 11 is attached to a stationary pin 81 by a spring 82 which thus continuously urges this support 11 into its forward position away from the stationary support 3, as shown in FIG. 1.

The above mentioned backing unit 12 (FIG. 7) comprises a backing member 83 which is fixed on a substantially L-shaped arm 84 pivotally mounted on a horizontal axle 131 carried by a slidable holder 85. The latter holder 85 is slidably mounted on a cylindrical rod 86 fixed on the bracket 5 and by element 87 on the side plate 4. The holder 85 is attached to one end of a cord 88 which is carried by a rotatable pulley 89 and attached at its other end in 90 to a rotatable pulley 91. The latter pulley 91 is coaxial with a smaller rotatable pulley 92 to which is attached, in 93, one end of a cord 94 the other end of which is connected to a slidable contact member 95, which is itself connected to a fixed nut 96 via a spring 97. The contact member 95 is slidably mounted in a slotted tube 98 made of plastics and is able to operate, through slots in this tube 98, armatures 99, 100, 101 of microswitches 102, 103 and 104 mounted alongside the tube 98. The microswitches each control a warning lamp.

Figure 7:
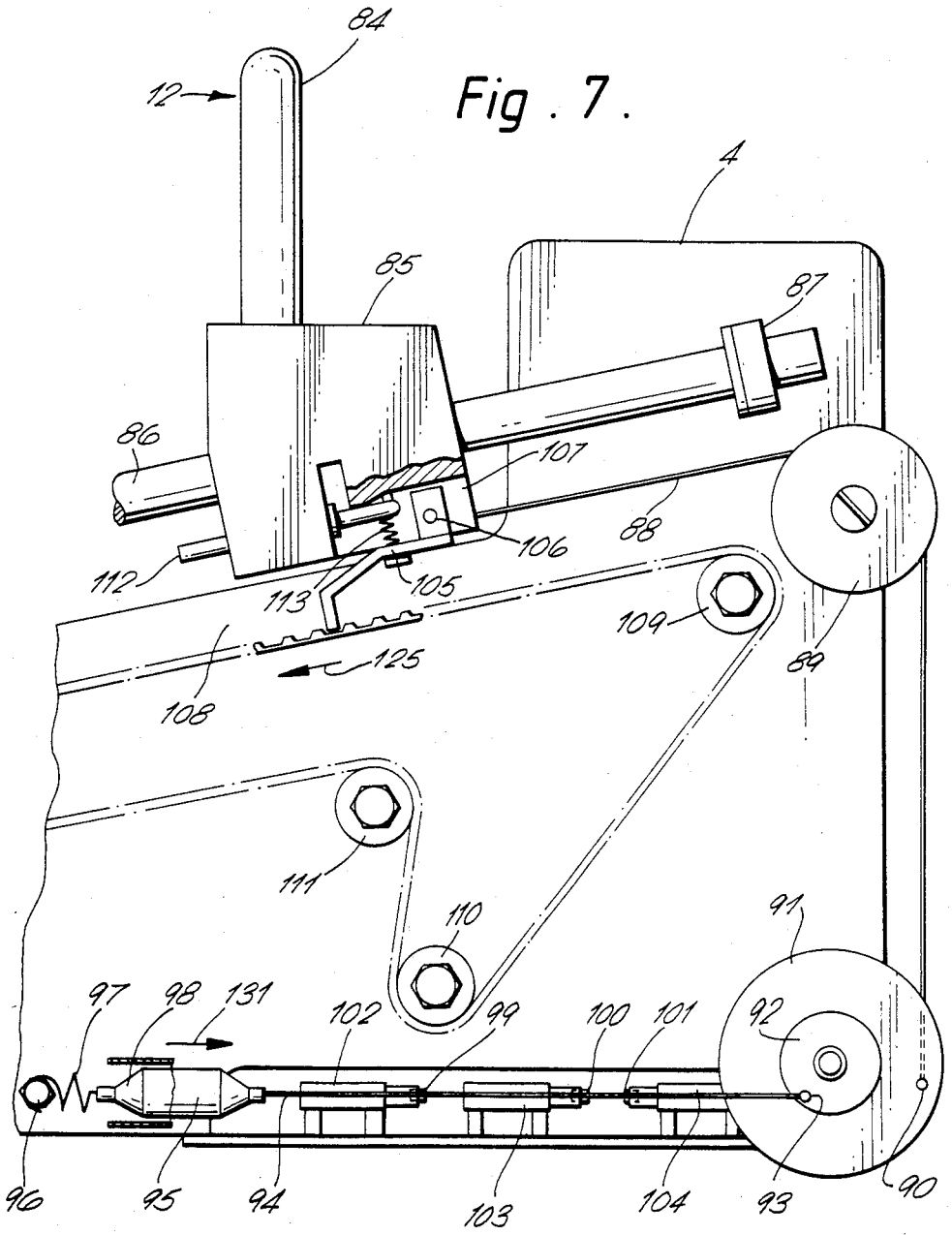
FIG. 7 is a side view at an enlarged scale and in the direction of arrow VII of the apparatus of FIG. 1 and after some frame parts thereof have been removed.

A spring-loaded locking pawl 105 (FIG. 7) is pivoted around a stationary axle 106 mounted in a cavity 107 of the holder 85. One end of this pawl 105 is normally engaged between two adjacent teeth of a positioning belt 108 carried by pulleys such as 109, 110, 111 whilst its other upstanding end is located in front of a slidable unlocking finger 112. A spring 113 mounted between the pawl 105 and an upper wall of the cavity 107 holds the end of the pawl 105 between adjacent teeth of the positioning belt 108 so that a displacement of this belt 108 is communicated to the holder 85. A displacement of the holder 85 independently of the conveyor 108 is possible in upward direction, without further operations being required, and in downward direction after having pushed the unlocking finger 112 which then pivots the pawl 105 in clockwise direction (FIG. 7).

The above mentioned bracket 5 is provided at each of its ends with an area 114, 115 having small square regions carrying numbers (not shown), the distance between like numbers being equal to the maximum stack length able to be loaded into a tray.

The displaceable tray supporting unit 13 (FIG. 1) mounted on the frame part 6 includes two fixed horizontal hollow guides such as 116 into each of which bars 117 and 118 are telescoping. Between the two parallel bars 118 are mounted a U-shaped vertical support 119, provided with a handgrip 132, and a horizontal plate 120. An inclined plate 121 is supported at one end by the inclined upper edge of the vertical support 119 and at the other end by the horizontal plate 120. The inclined plate 121 is adapted to carry a tray 122 in such a way that the front wall of this tray is substantially parallel to or forms a relatively small angle with the front end of a stack carried by the support 3, 11.

The conveyor belt 14, the deflection and stiffening unit 57 and the axle 69 are driven by a same motor (not shown) and the three belts 8–10 and the toothed belts 70 and 108 are driven by another motor (not shown) the operation of which is controlled (not shown) by microswitch 36.

As already mentioned the above described article stacking and tray loading apparatus is particularly intended for handling mail, such as envelope 123 (FIG. 2).

Initially the backing unit 12 is slid on the inclined rod 86 into its uppermost position wherein the backing member 84 is in close proximity of the conveyors 30 and 31 and is locked in this position due to the fact that an end of the pawl 105 is engaged between two adjacent teeth of the toothed belt 108. The control arm 35 maintains the microswitch 36 in an inoperative position wherein it prevents the above mentioned motor driving the conveyor belts 8–10, 70 and 108 from being energized.

The apparatus is put into operation by energizing (not shown) the above mentioned motor driving the conveyor belt 14, the deflection and stiffening unit 57 and the axle 69. The driving conveyor belt 14 drives the three-pulley member 16, 17, 18 in anti-clockwise direction (FIG. 4) so that also the conveyor belts 30 and 31 and the two-pulley members 26, 27 and 28, 29 are driven in the direction of arrow 124 and in anti-clockwise direction (FIG. 4) respectively. When envelopes such as 123 are fed one at a time to the stacking mechanism 7 they are advanced by the edgewise conveyor 14, 15, 16, 62 with their bottom edge remaining on the level of the base plate 1 and simultaneously curved to increase their rigidity. This is due to the centre portion of each envelope 123 being maintained in a vertical plane by the combined action of elements 14, 15 and 62 and by the action of the beveled rims of the wheels 63 and 65 on the upper and lower portions of this envelope 123 respectively. Also the radial flexible vanes 67, 68 act on the envelope 123 but this remains without effect as long as they do not operate on the rear edge thereof.

Due to the bottom edge of the advancing envelope 123 being at a higher level than the helical rib of the cylindrical portion of the axle 69 the front portion of this envelope passes over this cylindrical portion of the axle 69 without being influenced thereby and then engages in a stacking position i.e. between the backing member 83 on the one side and the friction belts 30, 31 on the other side. When this happens the rear portion of the envelope 123 tends to deflect out of the plane of the conveyor belt 14 and in anti-clockwise direction (FIG. 4) due to its rigidity and because these front and rear portions then make an angle. However such a deflecting movement cannot take place as long as this rear portion is engaged between the roller 62 and the belt 14.

At the moment the rear edge of the envelope 123 is engaged between the roller 62 and the belt 14 it is also submitted to the action of the flexible radial vanes 67, 68 which mainly have for effect to deflect the rear edge out of the plane of the conveyor belt 14, such a deflection being enhanced by the rigidity of the envelope 123.

Shortly after the rear edge of the envelope 123 has thus left the deflection and stiffening unit 57 its lower edge leaves the base plate 1 so that it can then drop by gravity and thus be submitted to the effect of the helical rib on the axle 69 and thus be further deflected. However this is only possible for relatively short envelopes as the front end of the longer ones is at that moment engaged between the backing member 83 on the one side and the friction belts 30, 31 of the pivotally mounted conveyor 30, 31, 35 on the other side. Thus such envelopes remain temporarily at the level of the base plate 1.

When the front portion of the envelope 123 is engaged between the pivotally mounted conveyor 30, 31, 35 and the backing member 83 and when its rear portion is no longer deflected by the deflection and stiffening unit 57 and has left base plate 1, it is deflected out of the plane of the conveyor belt 14 by its rigidity. Simultaneously its rear portion is canted downwardly and thus submitted to the effect of the helical rib of the axle 69 and thus deflected out of the plane of the conveyor belt 14. This canting movement is due to the fact that the friction belt 30 is made of a material having a higher friction coefficient than that of the friction belt 31 so that the lower portion of the envelope 123 is driven at a higher speed than the upper portion thereof.

From the above it follows that by the action of the flexible vanes 67, 68 as well as by the combined action of the axle 69 and the canting means including the friction belts 30, 31 the envelope 123 is deflected out of the plane of the conveyor 14 in the direction of conveyor belts 8–10. In this way the envelope 123 cannot hinder the arrival of an envelope immediately following the envelope 123 so that an increased operation speed of the apparatus is possible.

At the moment the front end of the envelope 123 engages in the stacking position between the friction belts 30 and 31 of the pivotally mounted conveyor 30, 31, 35, on the one side, and the stationary backing member 83 on the other side the latter conveyor is pivoted about axle 19 in anti-clockwise direction against the action of spring 32. As a consequence the microswitch 36 is operated due to which the motor controlling the displacement of the belts 8–10, 70 and 108 is energized.

By the displacement of the toothed belt 108 in forward direction, i.e. in the direction of arrow 125 (FIG. 7), also the backing member 83 is displaced in forward direction but the envelope 123 is maintained into contact with this backing member 83 as also the flat positioning conveyor belts 8–10 acting on the bottom edge of the envelope 123 are displaced in forward direction, i.e. in the direction of arrow 126 (FIG. 3).

The above operation repeats for every envelope fed into the stacking mechanism 7 and thus a stack of envelopes such as 127 (FIGS. 8, 9) is gradually built up on the inclined support 3, the front envelope 123 of the stack 127 being supported by the backing member 83. Each time the backing unit 12 is displaced in forward direction 125 (FIG. 7) the contact member 95 is displaced in the direction of arrow 131 (FIG. 7) in the tube 98. The contact member 95 and the micro-switches 102, 103 and 104 have now been so arranged:

that the microswitch 102 is operated by the contact member 95 when a stack has been formed which covers 75% of the total stack capacity of the inclined support 3. The microswitch 102 is used to illuminate a corresponding 75% capacity lamp (not shown) to warn the operator of the apparatus of this fact;

that the microswitch 103 is operated by the contact member 95 when a stack has been formed which covers the total stack capacity of the support 3. The microswitch 103 is used to illuminate a corresponding 100% capacity lamp (not shown) to warn the operator that the stack formed has to be loaded in a tray;

that the microswitch 104 is operated by the contact member 95 when a stack has been formed which covers the total stack capacity of the inclined support 3 and the slidable support 11. The microswitch 104 is used to stop the feeding of envelopes and to illuminate a corresponding lamp (not shown).

When envelopes are no longer fed to the stacking mechanism 7 the above mentioned pivotally mounted conveyor pivots in clockwise direction under the action of spring 32 and thus brings microswitch 36 in its inoperative condition wherein it stops the operation of the motor controlling the displacement of the belts 8–10, 70, 108.

The purpose of toothed belt 70 is as follows. When there is formed a stack of relatively short letters which is such that the front edges of these letters abut against the abutment plate 40 whilst their rear edges are not submitted to the action of the helical rib on the axle 69, these letters have a tendency to fan out in backward direction in the space formed between the backing member 83 and the portions of the belts 14, 30 and 31 making an angle with this backing member 83. Such fanned-out envelopes would hinder the arrival of new envelopes and would thus cancel the effect of the radial vanes 67, 68, and of the axle 69. This fanning-out is now prevented due to the fact that the letters of the stack are displaced in forward direction 126 (FIG. 3) by the toothed belt 70.

Figure 8:
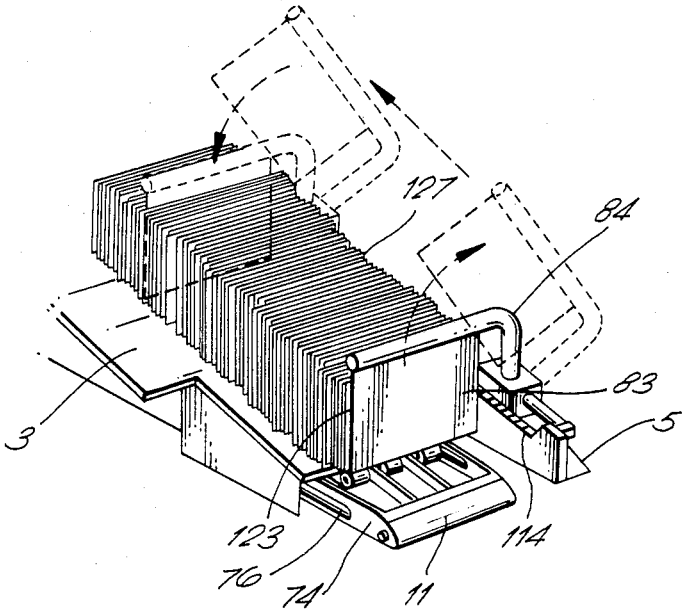
FIGS. 8 and 9 are perspective views of part of a tray loading apparatus included in the apparatus of FIG. 1 to illustrate the operation thereof.
Figure 9:
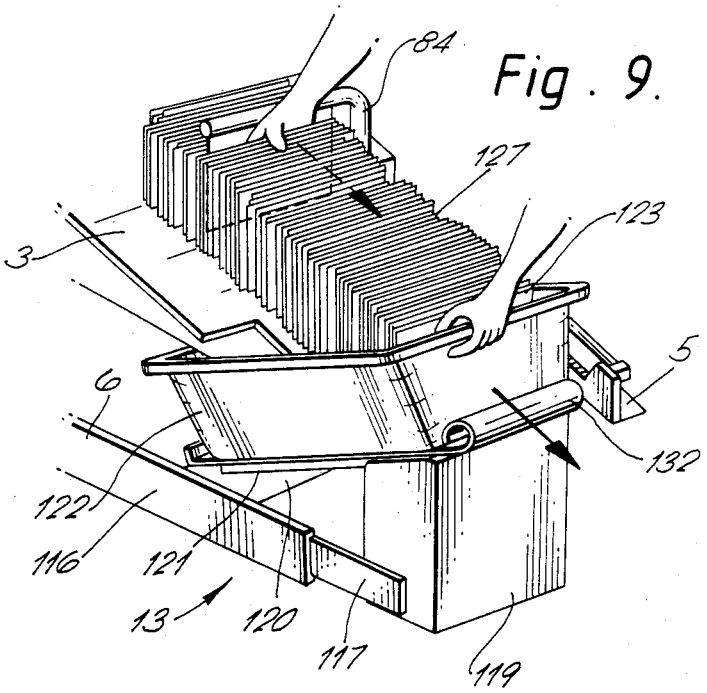

When an operator wants to transfer a stack into the tray 122 he puts this tray 122 on the tray loading unit 13 (FIG. 4) and slides it rearwardly, i.e. in the direction of the inclined support 3, until the front wall of this tray 122 is in close proximity of the backing member 83 (FIG. 9). He then swings up this backing member 83 the function of which is immediately taken over by the forward end wall of the tray 122 (FIG. 9) as the latter wall which is substantially parallel to the forward envelope 123 of the stack 127 now supports this stack. The backing member 83 which was positioned in front of a certain number of the area 114 on the inclined bracket 5 is again brought in the stack in front of the same number of the area 115 on the bracket 5 or of a smaller number (FIG. 8). In this way the stack to be transferred into the tray 122 has a length which does not exceed that of the tray 122. The whole stack located in front of the backing member 83 in the new position is then manually slid into the tray 122 as shown in FIG. 9, the tray 122 being thereby displaced in forward direction.

Because part 11 is slidably mounted and the forward envelope 123 of a stack 127 to be loaded is always located between the end of the stationary support 3 and the end of the displaceable support 11, when in extended position, the tray 122 can always be brought with its front wall in close proximity of the forward end of the support 3, 11 and into abutment with the forward envelope 123 of the stack 127. Thus this front wall can immediately take over the function of the backing member 83 when the latter is removed.

While the principles of the invention have been described above in connection with specific apparatus, it is to be clearly understood that this description is made only by way of example and not as a limitation on the scope of the invention.

We claim:

1. Tray loading apparatus comprising:

stack supporting means for a stack of flat articles, said stack supporting means including a stationary support surface and a movable support surface extending beyond the front end of said stationary support surface;

spring means for urging said movable support surface away from said stationary support surface;

a removable stacking plate member for retaining the front of said stack, said plate member being pivotally carried by a holder slidably mounted on an inclined rod mounted along said stationary support; and tray supporting means adjacent said movable support surface, said tray supporting means being movable toward and away from said movable support surface whereby the front wall of a tray can be brought into abutment with the front end of the stack after said stacking plate is removed so that said stack can be transferred into said tray.

2. Tray loading apparatus according to claim 1, further comprising at least one flat positioning coveyor belt mounted on the upper surface of said stationary support surface and coupled to a displacement means for displacing a stack carried by said stationary support toward said tray supporting means.

3. Tray loading apparatus according to claim 1 wherein said holder houses a spring-loaded locking pawl which is continuously urged between successive teeth of an inclined toothed belt, said spring-loaded pawl being pivotable so as to be thus disengaged from between said successive teeth by an unlocking finger to allow a downward movement of said holder on said inclined rod.

4. Tray loading apparatus according to claim 3 wherein said holder is attached to a slidable contact for successively controlling the operation of microswitches to thus indicate the position of said stacking plate member and the length of said stack.

* * * * *